United States Patent [19]

Bochtler et al.

[11] Patent Number: 5,069,659

[45] Date of Patent: Dec. 3, 1991

[54] APPARATUS FOR THE PRODUCTION OF SHOPPING BAGS HAVING REINFORCED HANDLE HOLES

[75] Inventors: Franz Bochtler, Rudersberg; Wilhelm Ley, Troisdorf, both of Fed. Rep. of Germany

[73] Assignee: Stiegler Maschinenfabrik GmbH, Rudersburg, Fed. Rep. of Germany

[21] Appl. No.: 454,278

[22] Filed: Dec. 21, 1989

[30] Foreign Application Priority Data

Dec. 22, 1988 [DE] Fed. Rep. of Germany ... 8815895[U]

[51] Int. Cl.[5] ..... B31B 23/86

[52] U.S. Cl. ..... 493/194; 493/204; 493/226

[58] Field of Search ..... 493/194, 195, 196, 204, 493/226

[56] References Cited

U.S. PATENT DOCUMENTS

| | | | |
|---|---|---|---|
| 2,768,560 | 10/1956 | Hirson | 493/372 |
| 3,071,046 | 1/1963 | Conant | 493/372 |
| 4,568,322 | 2/1986 | Piggott | 493/461 |
| 4,702,731 | 10/1987 | Lambrecht et al. | 493/196 |
| 4,735,602 | 4/1988 | DeBin | 493/204 |

FOREIGN PATENT DOCUMENTS

| | | |
|---|---|---|
| 834398 | 2/1976 | Belgium . |
| 2645560 | 4/1977 | Fed. Rep. of Germany . |
| 2162894 | 7/1973 | France . |
| 470963 | 5/1989 | Switzerland . |
| 2170145 | 7/1986 | United Kingdom . |

*Primary Examiner*—William E. Terrell

*Attorney, Agent, or Firm*—Antonelli, Terry, Stout & Kraus

[57] ABSTRACT

An apparatus for the production of shopping bags provided with handle holes reinforced by welded-on tabs of thermoplastic synthetic resin film includes a unit for effecting cyclic stepwise advancement of film webs forming sides of each bag; a unit for punching handle holes into the welded-on tabs and devices for welding and severing of the films webs to form individual shopping bags transversely to the direction of the advancement of the film webs, as well as a device for feeding tabs of thermoplastic synthetic resin films to positions on the film webs and for welding the tabs to the film webs. The device for feeding and welding of the tabs comprising a turntable which is rotatable about an axis perpendicular to the advancing direction of the film webs which operates cyclically in synchronism with the stepwise advancement of the film webs.

6 Claims, 9 Drawing Sheets

2
3
4
5
6

APPARATUS FOR THE PRODUCTION OF SHOPPING BAGS HAVING REINFORCED HANDLE HOLES

This invention relates to an apparatus for the production of shopping bags from thermoplastic doubleply synthetic resin film web with handle holes formed by cuts into the film plies and with reinforcing tabs from films of a thermoplastic synthetic resin, surrounding the handle holes and welded to the insides of the film plies, with an unwinding unit for the film web, optionally with a folding unit for the production of double-ply film web, with a web draw-in device for the continuous take-off of the film web at the inlet side and cyclic stepwise advance at the outlet side, with a feeding unit or device for the reinforcing tabs to be severed in sections from two film strips, this feeding unit being controlled synchronously in cyclic fashion with the advance of the film web, the tabs being intended for being welded to respectively one film ply, with a strip unwinding unit with feed rolls for the film strips, with a separating plate arranged between the two film plies for spacing apart the two film strips that can be fed in superposition transversely to the feeding direction of the film web and with a cutting means for severing the reinforcing tabs from the film strips, with a turntable rotatable about an axis perpendicular to the feeding direction of the film web cyclically in synchronism with the stepwise advance of the film web, this turntable projecting with a portion between the film plies of the film web and being equipped on the topside and bottom side with holding places exposable to a vacuum for the depositing and retaining of the reinforcing tabs, a welding unit for welding the reinforcing tabs to the film plies being associated in each case on the topside and bottom side with the holding places extending farthest in between the film plies, the separating plate, while leaving an entrance gap for the blade, adjoining the holding place of the turntable located outside of the film plies; as well as with a punching unit for punching the handle holes into the film web, and devices for the welding and severing of the shopping bags from the film web transversely to the feeding direction.

A machine of the type discussed herein has been known from DOS 2,645,560 wherein the reinforcing tabs for the handle holes are deposited by way of a feeding means on a turntable and are placed by stepwise rotation into a welding position. In this arrangement, problems are encountered in the transfer and the exact depositing of the reinforcing tabs of film on the turntable since the thin film is readily gathered and forms creases and slips out of place.

The invention is based on the object of improving the conventional machine with feeding device for the reinforcing tabs in such a way that in all cases an exact and flawless depositing of the reinforcing tab on the turntable is accomplished, and thus higher production rates are attainable. Also, a continuous operation of the machine is to be made possible while avoiding idle cycles, i.e. an interruption in the feed of the film web.

The invention attains the thus-posed objective by further developing the feeding device for the reinforcing tabs to be cut off from film strips in such a way that the separating plate exhibits, on the topside and bottom side, grooves extending in the feeding direction of the film strips; that respectively one drivable advancing roll provided with annular grooves is associated with the topside and bottom side of the separating plate and cooperates with respectively one counter roll arranged in the separating plate and equipped with annular grooves in such a way that the grooves of the advancing roll and the grooves of the counter roll are in mutual opposition and form slotted chambers in alignment with the grooves of the separating plate, and rods are arranged in a self-supporting fashion, extending through the grooves as well as through the slotted chamber, respectively one through each groove and chamber, and the draw-through slot for the film strips is formed between the zones of maximum diameter of the advancing roll and counter rolls and the route enforced by the rack-shaped rods in the slotted chambers, whereby an undulated discharge gap for the film strips is formed transversely to the feeding direction of the film strips and, as seen in the feeding direction, downstream of the end of the separating plate, respectively one blade that can be moved up and down transversely to the feeding direction of the film strips is disposed above and, respectively, below the plane of the separating plate.

Thus, in accordance with this invention, the feeding device for the production of the reinforcing tab is fashioned so that the film strips, from which the reinforcing tabs are formed, are undulated, namely in such a way that the apex lines of the wave crests and troughs extend in the longitudinal extension and in parallel to the feeding direction of the film strips whereby an increased rigidity is imparted to the film strips, and the latter can be moved forward, when leaving the separating plate and being fed onto the turntable, in a self-supported fashion and without buckling perfectly up to the receiving position on the turntable. After advancing the thus-undulated ends of the two film strips in a size and length corresponding to the reinforcing tab, severing of the reinforcing tabs, i.e. of the wavy ends of the film strips, is performed by means of respectively one blade for the upper and lower film strips, while the feed for the film strips is arrested and the turntable is at a standstill.

The rods are connected at one end comb-like together and are guided in a self-supporting fashion in the grooves and are supported at the connected end projecting past the wedge-shaped region of the separating plate in a toothed member, these rods pertaining to the undulating device. The rods are also adjustable in this holder.

The only brief corrugating of the film strip during transfer and up to the positionally accurate depositing on the turntable is subsequently erased since the reinforcing tabs are to be welded in flat contact with the film plies around the subsequent handle holes of the carrying bag. For this purpose, in a further development of the machine, it is suggested that each blade be attached to a cutter bar vertically movable on guide rods; that a holddown plate is mounted in a resiliently yielding fashion to the cutter bar, the surface of this plate being ribbed or grooved in parallel to the feeding direction of the reinforcing tabs, and this holddown plate projecting somewhat beyond the blade cutting edge in the direction toward the holding plate of the turntable. This design of the arrangement achieves the objective that upon a vertical movement of the cutter bar for severing the reinforcing tabs from the film strip, first the holddown plate comes into contact with the corrugated film strip end resting on the turntable, pressing this end smooth and retaining same, whereafter the cutting step is performed. In order to permit a flawless subsequent lifting of the holddown plate off the severed reinforcing tab lying on the turntable and held in contact therewith by suction with the aid of the vacuum passed through the turntable, the holddown plate is of a ribbed structure.

In a further development of the invention, it is suggested that the drive operations required by the feeding unit for advancement of the film strip, severing of the reinforcing tabs, movement of the turntable, and welding of the reinforcing tabs to the film plies, take place from a driven shaft — intermediate shaft which is driven either by the main drive of the machine controlling the feed of the film web or by a separate drive motor. In order to provide adaptation of the feeding unit for the reinforcing tabs to varying bag widths and thus positions of the reinforcing tabs, it is proposed to arrange the feeding unit for the film strips to be displaceable in parallel to the advancing direction of the film web.

In a further embodiment of the invention the provision is made to branch off, from the driven intermediate shaft, the individual drive mechanisms for the feed rolls and the unwinding device for the film web feed, the reciprocating movement of the blades for cutting the reinforcing tabs off the film strips by way of a cam disk and a lever linkage, the turntable with stepping gear, and the reciprocating motion of the welding dies for welding the reinforcing tabs into place by way of a cam disk and lever linkage.

In case the feeding device, while the machine is running, is to be rendered inoperative, or the machine requires idle cycles for certain depositing systems for the thus-manufactured carrying bags, the feeding of the reinforcing tabs must be interrupted for the time of the idle cycles. This is made possible, for example, by arranging a pneumatically operable single-speed clutch upstream of the branch-off point for the individual drive mechanisms for the various functions of the feeding device. This clutch can be arranged on the intermediate shaft and shuts off, upon being activated, the feeding device completely, i.e. the turntable, the welding units, the blades and the feed for the film strips are shut down. Upon restarting of the machine, the clutch effects an immediate connection.

Additional details of the apparatus according to this invention will be described hereinafter with reference to an embodiment illustrated in the accompanying drawings wherein.

Figure 5:
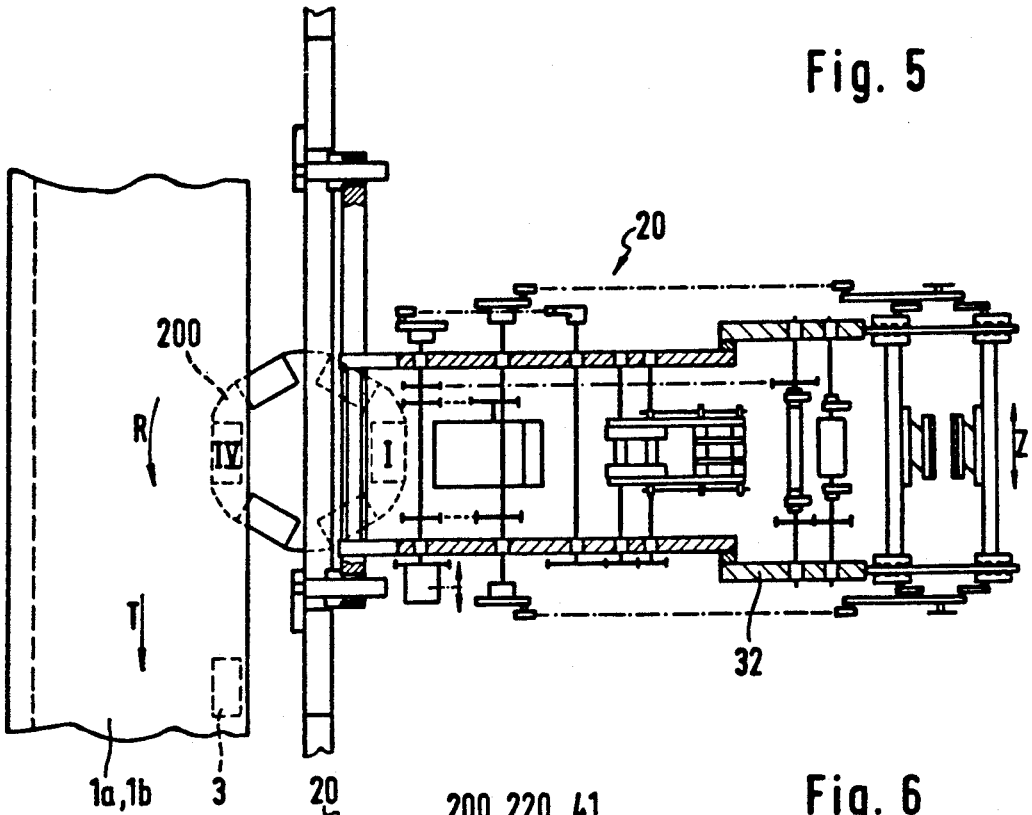
Figure 6:
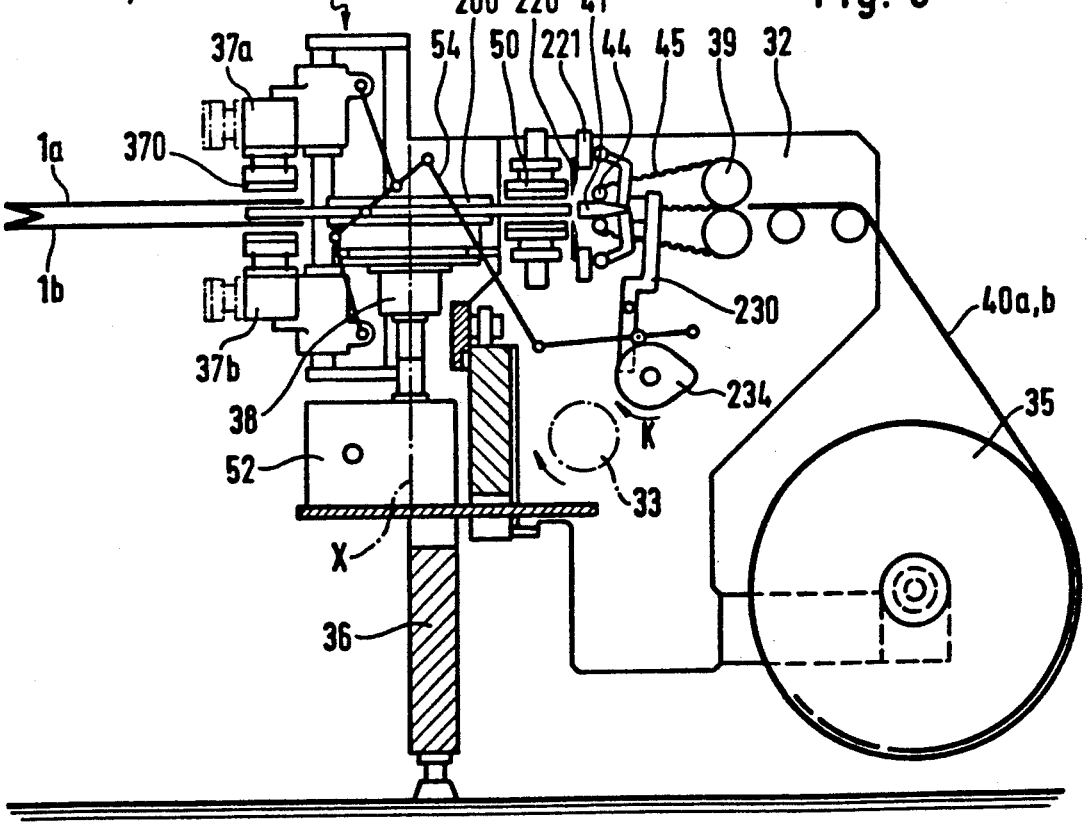
Figure 7:
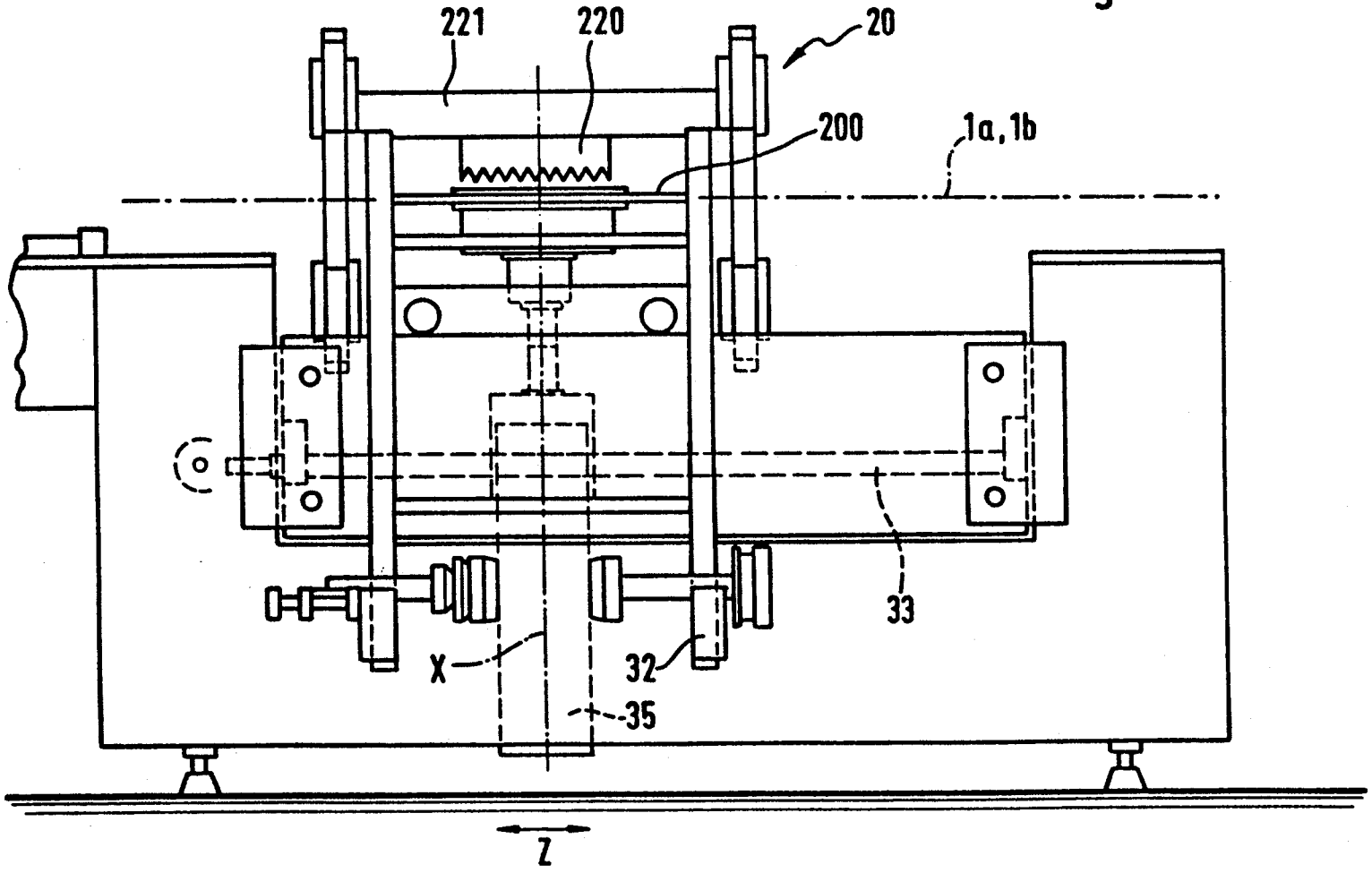
Figure 8:
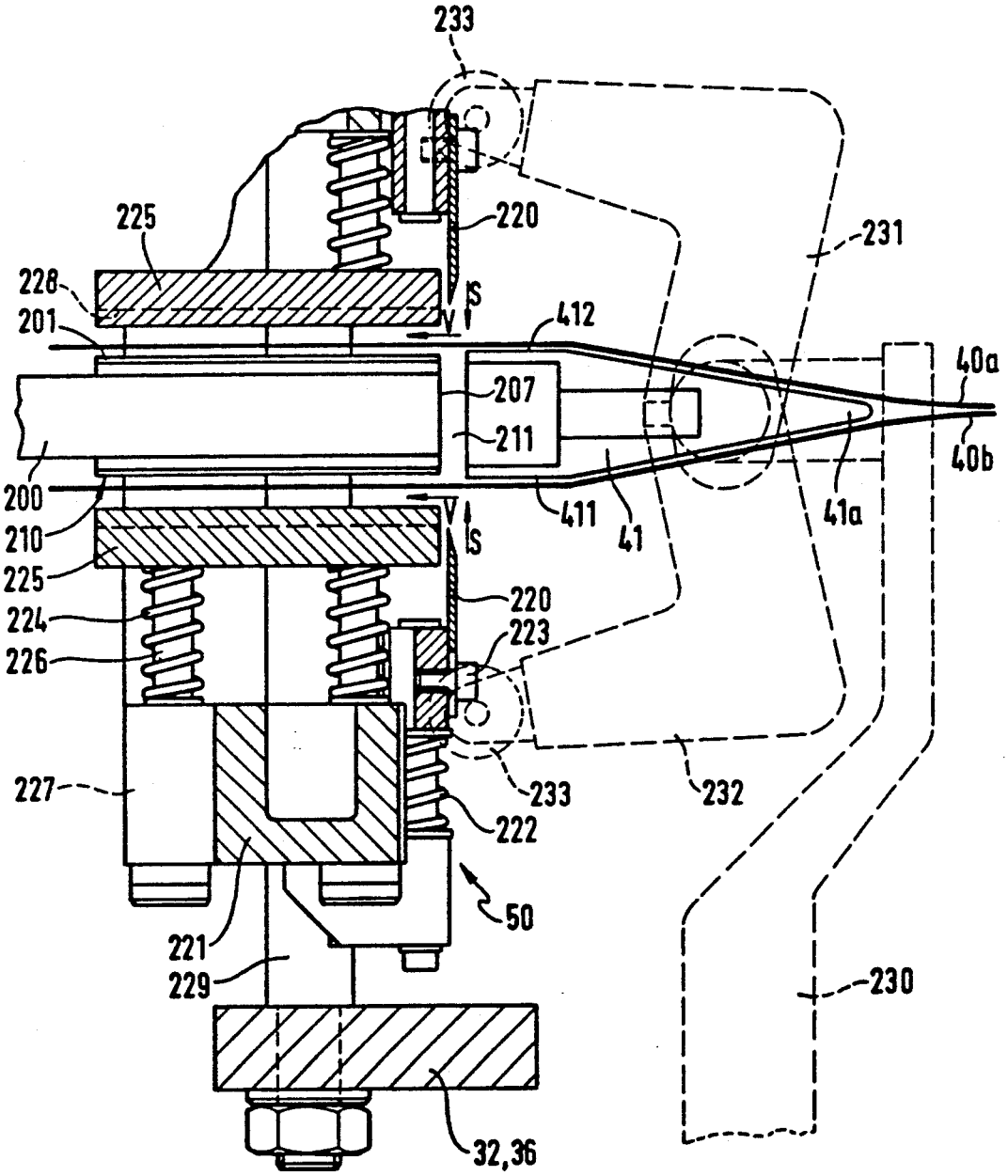
Figure 9:
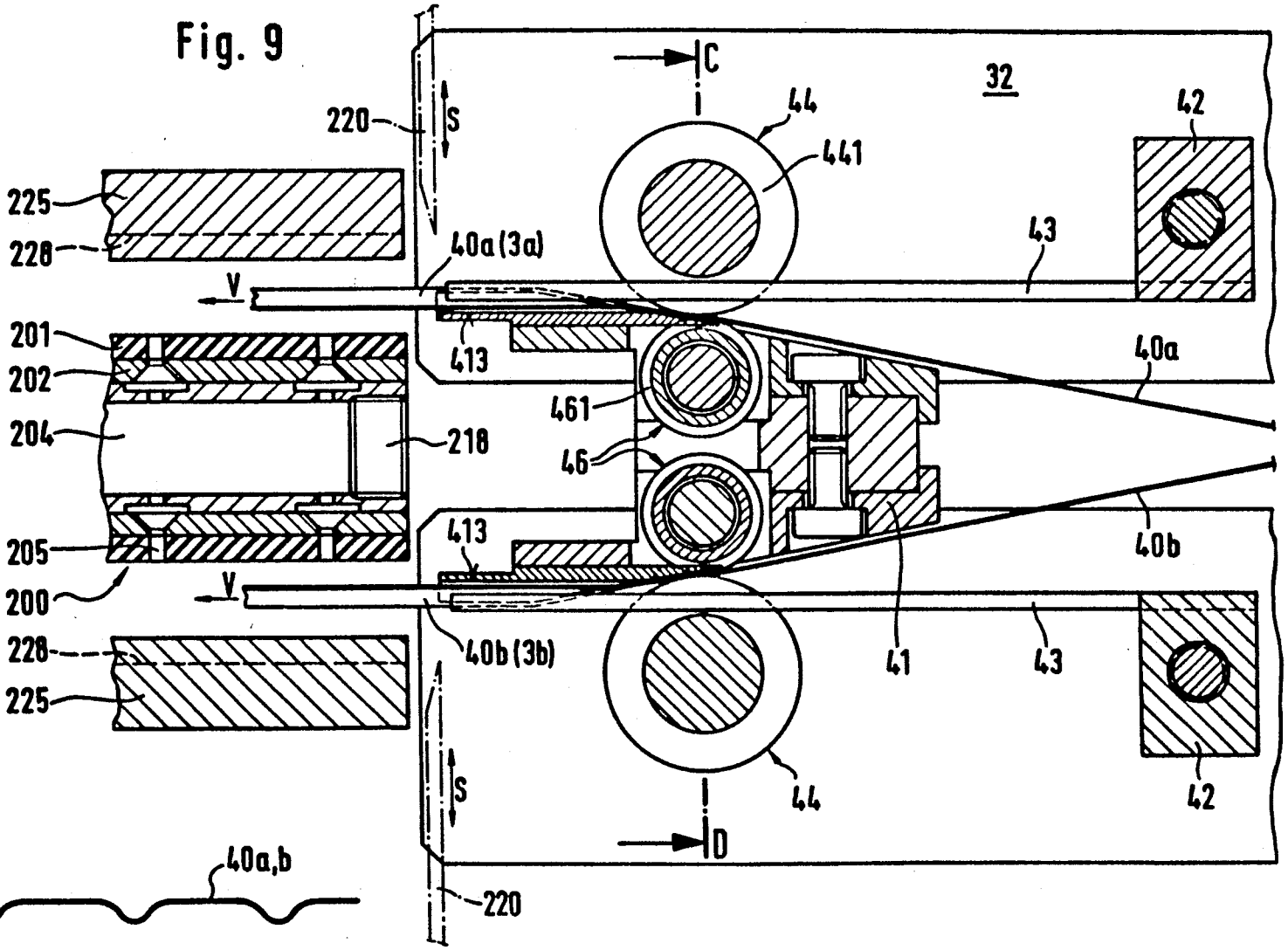
Figure 10:
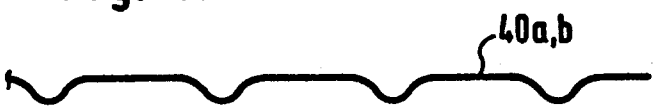
Figure 11:
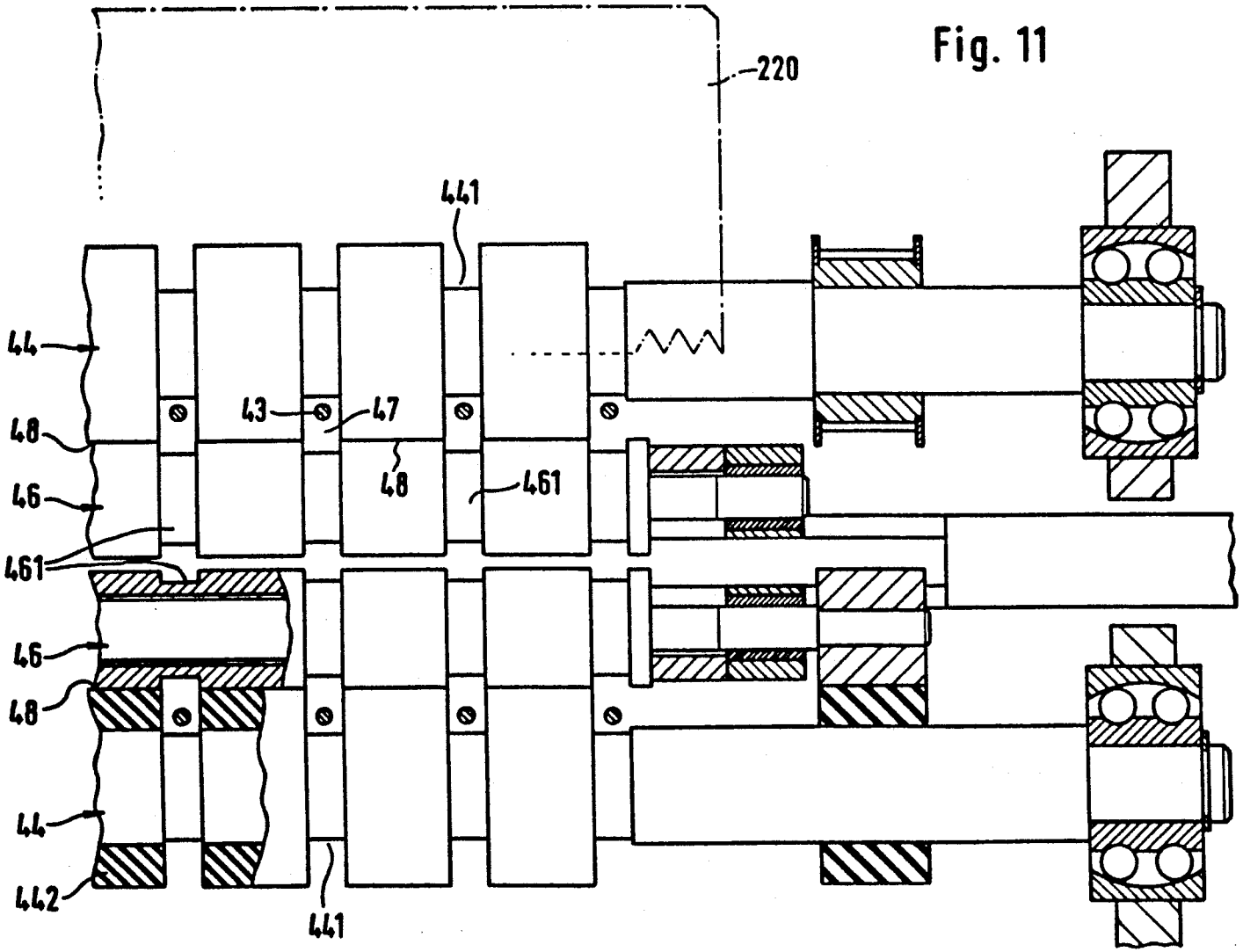
Figure 12:
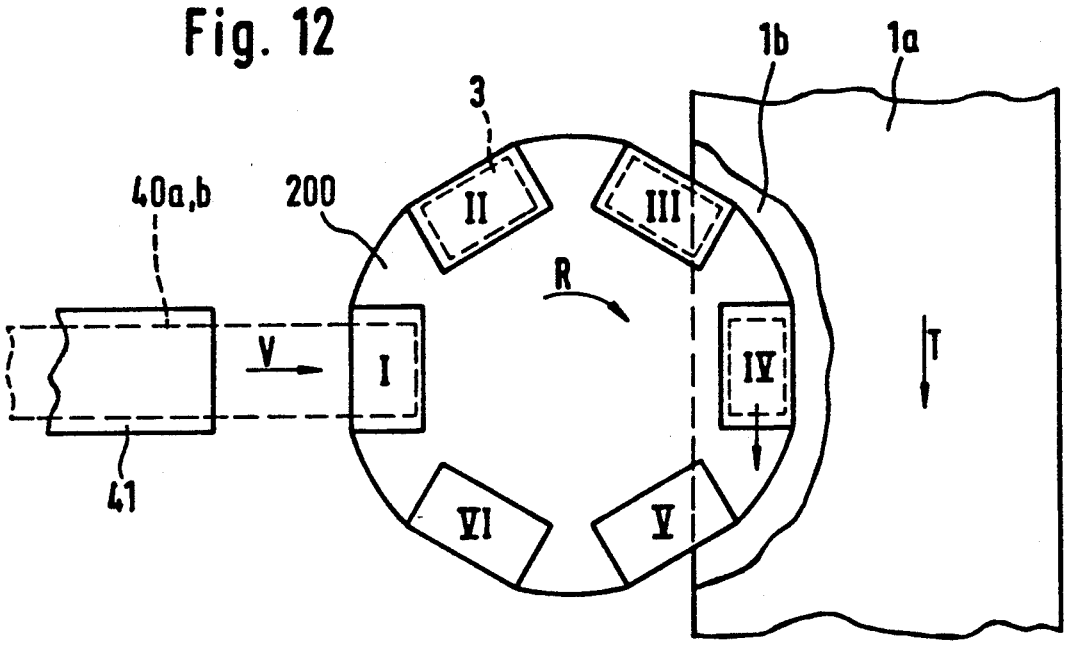

FIGS. *3a–3e* show various shopping bags in a front view and schematically in cross section;

FIGS. *4a* and *4b* respectively show, a fragmentary view of the turntable and a section along line H—H in FIG. *4a* on a reduced scale, for a feeding device;

FIGS. 5, 6 and 7 respectively show, schematically a top view, a lateral view, and a front view of a feeding device for the reinforcing tabs;

FIG. 8 shows a detail in longitudinal section through a cutting device with holddown plate and turntable;

FIG. 9 shows a detail in a cross-sectional view through a separating plate with feeding of the film strip up to the cutting device;

FIG. 10 is a cross section through a corrugated film strip;

FIG. 11 is a detail in cross section along line C–D of FIG. 9;

FIG. 12 is a schematic top view of a turntable; and

Figure 13:
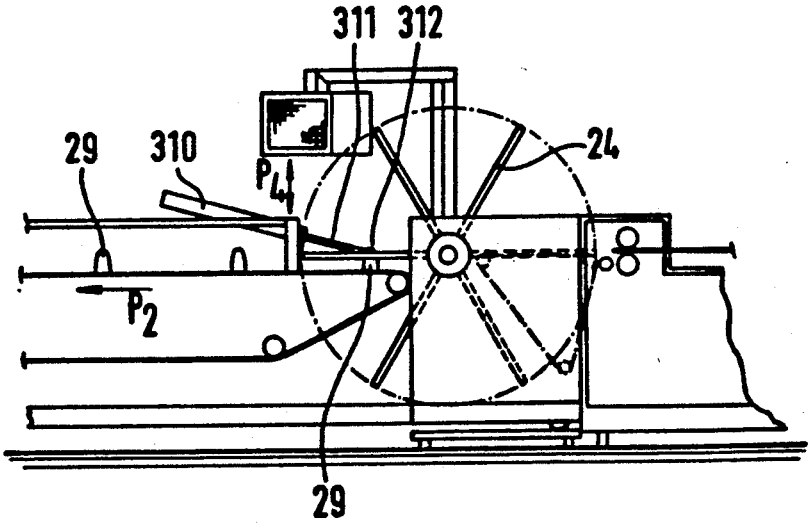

FIG. 13 shows an apparatus in a schematic partial illustration, with idle cycle unit.

Figure 1:
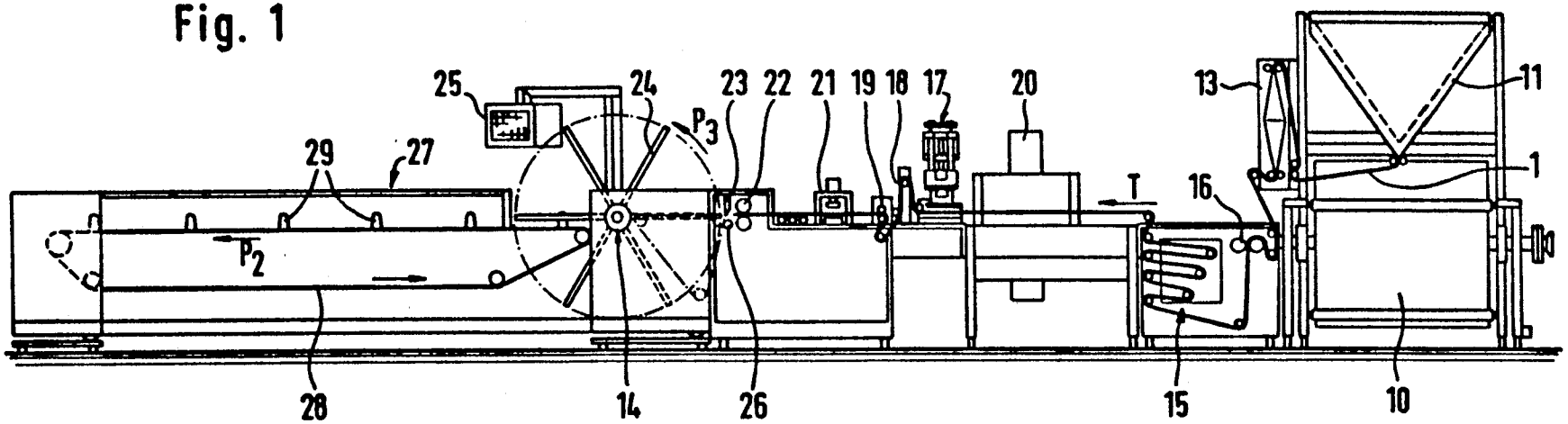
FIG. 1 shows a schematic lateral view of a apparatus for the production of shopping bags with welded in reinforcing tabs.
Figure 2:
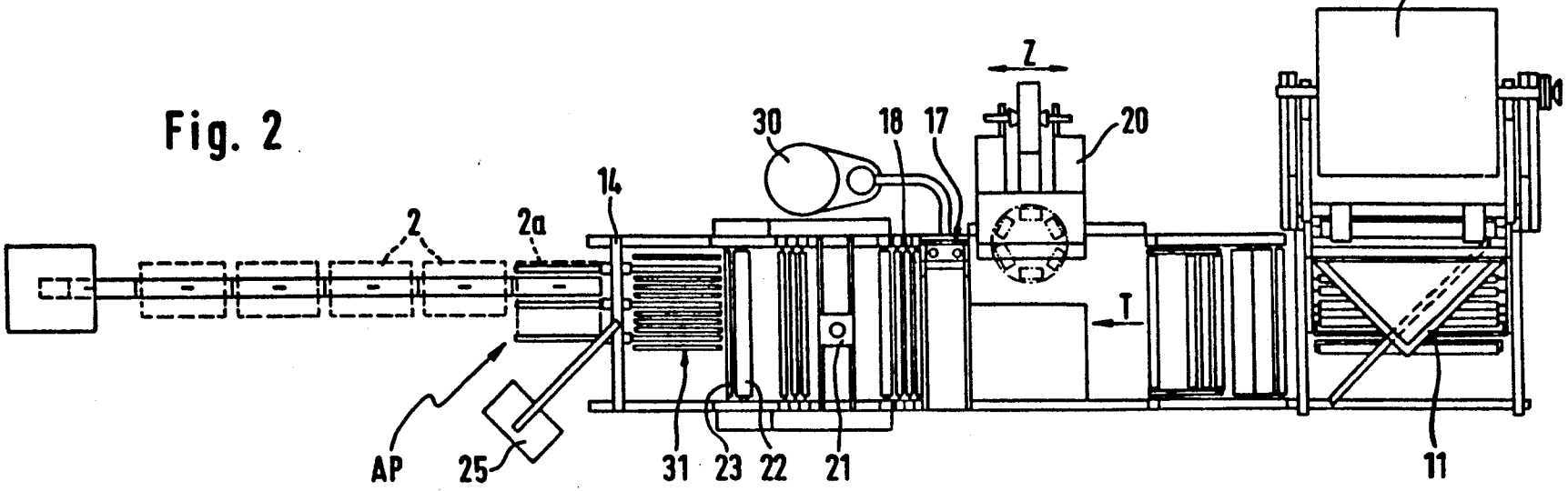
FIG. 2 is a schematic top view of the machine according to FIG. 1.

Shopping bags 2 according to FIG. 3, for example, can be manufactured by means of the apparatus illustrated schematically in FIGS. 1 and 2 from synthetic resin film webs 1. The shopping bags can be provided with an inlaid bottom fold 5 at the bottom; the bags exhibit welded side seams 6 and, in the zone of the bag opening, the handle holes 4 which are located within the bag 2, see FIGS. *3a–c*, and are surrounded on the inside by welded-on reinforcing tabs 3 of thermoplastic synthetic resin film. The handle holes 4 can also be arranged on a section, projecting in part past the bag opening, of reinforcing tabs 3 welded to the walls of the bag 2 on the inside; see FIGS. *3d* and *3e*. The apparatus in accordance with FIGS. 1 and 2 can be utilized in a single-lane design for the production of shopping bags 2, or also with a twin-lane design, i.e. for the paired manufacture of shopping bags 2, including the appropriate equipment. In the apparatus according to FIGS. 1 and 2, the film web 1 is continuously taken off the film roll 10 and guided over a folding triangle 11 and folded in half, the folding edge corresponding to the bottom edge of the shopping bag extending in the machine and the film rims being conducted along a side edge. If the shopping bag is to be fashioned with a bottom crease, this can be done by guiding the folded film web through the folding unit 13. Thereafter, the film web is conducted over a driven pair of feed rolls 16 into the feed-compensating device 15 serving as an accumulating station for the cyclic stepwise advance of the film web taking place on the outlet side. The double over film web 1 is then transported cyclically by, respectively, one bag width and passes through the feeding station 20 wherein the reinforcing tabs 3 are welded in place to the insides of the film layers or portions of the film web in the zone of a subsequently formed handle hole. Thereafter, the hole punching means 17 is used to punch the handle hole. Via correcting rolls 18 for setting the increments lengthwise in correspondence with the bag width, and via another driven pair of feed rolls 19, the film web is passed on to a cutoff welding unit with, for example, a cutoff welding blade 23 and a welding counter roller 26, by way of the driven pair of feed rolls 22. At this location, the cyclic transverse cutoff welding of the lateral weld seams 6 is carried out, simultaneously severing the bags 2; the bags then drop down to a depositing grating 31 constituted by revolving belts or strings and are lifted by the continuously passing, rotating suction arms 24 of a subsequent paddle wheel 14 and are deposited on the depositing facility 27 at the closest-located depositing station with holding pegs 29, to form a stack *2a*. After depositing a desired number of shopping bags into a stack, the depositing sites are moved on in direction of the arrow $P_2$ by a cyclically stepwise moving conveyor belt 28. The apparatus is equipped with a control console 25 arranged at a swivel arm.

During the time required for the stepwise advancement of the stack *2a* and the positioning of a new empty depositing station in the depositing position AP for the suction arms 24 of the paddle wheel, no bags can be deposited with the illustrated equipment of the machine according to FIGS. 1 and 2. Several idle cycles must be interposed, i.e. no bags may be welded and severed and conveyed beforehand -for this purpose, the compensating device 15 is needed for the film web, and the advance of the film web as well as the operating units are correspondingly controlled. It is, however, also possible as shown in FIG. 13 to provide an interim depositing device 310 in the region of the depositing position AP which has a finger 311 that can be moved to and fro pneumatically in the feeding direction $P_2$, with holding peg 312 for shopping bags 2, this depositing device being additionally movable upwards and downwards in the direction of arrow $P_4$. In the rest position, the finger 311 is retracted; if needed — when the depositing station with stack 2*a* is moved in the direction of arrow $P_2$ — the finger 311 is extended, engaging between the suction arms 24, for example as shown in FIG. 13, so that its holding peg 312 is located above the position of the holding peg 29, and bags can be deposited thereon. After the end of this step, i.e. when a holding peg 29 is again located in the deposition station AP, the finger 311 is lowered, see illustration of FIG. 13; the collected bags are transferred by finger 311 to the holding peg 29, and the finger 311 is again retracted in the direction of arrow $P_2$, i.e. is rendered inactive. By means of this device 310, empty cycles for the machine are avoided.

The paddle wheel rotates in the direction of arrow $P_3$. For increasing the tear-out strength of laid-in bottom folds in the shopping bags 2, it is possible to join them additionally in the welding station 21 by a preliminary weld along the side edges. The preliminary welding unit 21 is adjustable on traverse rods transversely to the feeding direction T of the film web in correspondence with the bag length. The machine also includes a blower, not shown, for the production of a vacuum for the suction arms 24 of the paddle wheel 14. Numeral 30 denotes a collecting vessel for the punching waste of the handle hole. The film web 1 is taken off continuously up to the feed compensating device 15 from the film roll 10 and then is further transported in a stepwise fashion by respectively one bag width; during standstill of the feed, the feeding device 20, the hole punching means 17, optionally the preliminary welding unit 21, and the cutoff welding unit 23, 26 operate in a cyclic fashion.

The feeding device 20 for the reinforcing tabs 3 is shown in FIGS. 5–7 in its structure in principle. The superimposed film plies 1*a*, 1*b* of the folded film web are guided in conveying direction T past the feeding device 20. The feeding device comprises the turntable 200, rotatable in stepwise fashion, about an axis X extending perpendicularly to the feeding direction T, in the direction of rotation R. The turntable is driven by way of a stepping mechanism 52. The turntable 200 is arranged along the side of the film web 1 at the machine in such a way that it projects with a section in between the two film plies 1*a*, 1*b*. The feeding device 20 including turntable 200 and stepping gear mechanism 52 is mounted to a frame 32 and is optionally displaceable in the direction of arrow Z in parallel to the conveying direction T in order to be able to alter the position of the turntable correspondingly in case of a variable bag width. For driving the feeding unit, a drive mechanism operating by way of a drive shaft and derived from the main drive unit of the machine is provided, or alternatively a separative drive mechanism is included. Either drive mechanism drives an intermediate shaft 33, also called an idler shaft 33. The individual drives for the various functions of the feeding unit 20 are derived from the idler shaft 33. The feeding device 20 has to fulfill several functions, namely from producing the reinforcing tab 3 to welding the latter onto the film plies. This is described in greater detail with reference to FIGS. 5–7, especially FIG. 6. In each case, two reinforcing tabs 3 are needed for the top and bottom film plies. These can be produced, for example, from film strips 40*a*, 40*b*, fed in parallel superposition, by severing these strips simultaneously. The two film strips 40*a*, 40*b* can be taken off, for instance, from a film strip roll 35 where they are dually wound up, or they can be produced, for example, by subsequent cutting open of a tube. The film strips 40*a*, *b* can be driven, for example, by the intermediate shaft 33 via a crankshaft, a connecting rod, not depicted, to the driven feed roller pair 39. Thereafter, the film strips 40*a*, 40*b* are conducted via a wedge-shaped separating plate 41 to the turntable 200 up to the level of the topside and underside of the turntable. After the top and bottom film strips 40*a*, 40*b* have been advanced in each case to the desired length on the topside and, respectively, bottom side of the turntable, the film strips 40*a*, 40*b* are severed while simultaneously exerting pressure with the holddown means 50, in the nip left between the turntable 200 and the separating plate 41, thus producing the reinforcing tab. In each case, an upper cutting blade and lower cutting blades 220 are provided, each attached to a cutter bar 221, the latter being at the same time connected to the holddown means 50. The vertical motion of the blades 220 is controlled by means of a lever linkage 230 via the cam disk 234 seated on a camshaft K. The severed reinforcing tabs, deposited on the turntable on the topside and bottom side, are retained on their depositing site on the turntable by suction generated by means of a vacuum. The turntable 200 is then further rotated by means of the stepping gear mechanism 52 by one position, i.e. in this case by 60′; after 3 cuts, the reinforcing tab deposited and retained in the turntable has arrived in the welding position IV lying in opposition to the receiving position I. Likewise while the film web and the turntable 200 are at a standstill, the reinforcing tab is respectively welded to the film ply 1*a* or 1*b* in contact therewith by applying the upper and lower welding dies 370. The welding dies 370 are arranged to be vertically movable at the welding units 37*a* and 37*b*, respectively, and the drive action is provided by a further cam disk, not shown, seated on the camshaft K and moving a lever linkage 54 with cyclic control; this linkage moves the welding dies.

FIGS. 5 and 7 do not show welding units 37*a* and 37*b* to preserve clarity. By changing the cam disk, the welding period, i.e. the residence time of the welding dies 370 can be adjusted The counter bearing for the welding dies is in each case constituted by the turntable 200. After removal of the welding dies 370, the turntable is again rotated further in the direction of arrow R by one position. The vacuum is turned off in the welding position during the welding step, and thus the reinforcing tab is released. It is advantageous to equip the turntable with six holding places for reinforcing tabs on respectively the topside and bottom side. In such a case, the reinforcing tab received in the loading station I will reach the welding station IV after three additional cycles. After the reinforcing tabs have been welded in place, the turntable can then cool off again until, after another three cycles, the loading position is again attained. Two or four positions are likewise possible.

Additionally to the driven pair of feed rolls 39 for the film strips, advancing rollers 44 are provided in the zone of the separating plate 41; these advancing rollers are driven via the feed rolls 39 by means of rotating chain belts 45. Numeral 36 denotes the machine frame, 38 means the bearing of a turntable 200. Thus, while the severing of the reinforcing tabs from the film strips takes place during standstill of the turntable and standstill of the film strips and standstill of the film web, with simultaneous welding on of the reinforcing tabs and simultaneously executed punching of the handle holes and transverse cutoff welding of the shopping bags, the turntable is rotated, during the advancement of the film web, by respectively one position, and the advancement of the film strip onto the turntable is effected. Additional functions are required during standstill of the machine, such as lifting of the welding die. Furthermore, slide valves are needed in the turntable for holding the reinforcing tabs in place by suction, i.e. for application of the vacuum, namely a slide valve must be opened in the zone of the loading station I after a new, empty holding place has been positioned, for example by means of a mechanical stop, and a slide valve must be closed for shutting off the vacuum in the zone of the welding station IV, for example by means of a mechanical stop, after the reinforcing tab with the turntable has reached the welding station. Furthermore, the feed roll pair 39 is equipped with a brake, not shown in detail.

For shutdown, terminating operation, or for temporary standstill, for example during idle cycles of the feeding unit, a pneumatically operable jaw clutch is provided, for example, which is associated with the main drive mechanism of the illustrated in detail, the feeding device can be completely turned on and off.

FIG. 8 shows a detailed construction in accordance with the invention of the blades and holddown means of the feeding device 20 for the reinforcing tabs in a sectional view according to FIG. 6 in ⅔ of full size. The film strips 40*a*, 40*b* are supplied via the separating plate 41 tapering to a wedge shape in the feeding zone 41*a*. The separating plate ends at the level of the turntable 200; the immersion gap 211 for the blades 220 remains between the separating plate 41 and the turntable 200. The film strips 40*a* and 40*b* are fed on the topside 412 and, respectively, bottom side 411 of the separating plate and advanced in the feeding direction V onto the turntable 200 at the holding place 210 formed at the rim. A layer 201 of sponge rubber is disposed on the holding place; therebelow, bores are provided in the turntable with connection to a pressurizing device Once the film strip advance has come to a standstill, a vacuum is applied to the holding place 210 from the side of the turntable so that the film strips are retained in their position by suction. At the same time, the reciprocating motion in the direction of arrow S is triggered for the blades 220 arranged on the topside and bottom side in front of the turntable, i.e. there is a blade for each film strip. The blades 220 are resiliently attached by means of screws 223 at the cutter bar 221 with the interposition of compression springs 222. The cutter bar is moved up and down on guide rods 229 in the direction of arrow S. Furthermore, facing the turntable, the holddown plates 225 are yieldingly resiliently supported at the cutter bar on guide rods 226 with the interposition of compression springs 224 in sliding bushings 227. In the raised condition, the holddown plate 225 projects with its bottom edge somewhat past the blade edge 220 so that upon movement of the blade or cutter bar 221 in the direction toward the turntable 200, first the holddown plate 225 firmly presses against the film strip lying thereon and then the blade severs the film strip and produces the reinforcing tab. The cutting motion of the blade and holddown means proceeds by way of the two mutually movable angle levers 231, 232, shown in dashed lines, which engage by means of rollers 233 arranged at their front ends into recesses, not shown, of the cutter bar 221 and are moved via the lever-like angle member 230 controlled by the cam disk 234. The holddown means are fluted on their surface facing the turntable with grooves 228 extending in the feeding direction V.

Figures 3A, 3B, 3C, 3D, 3E:
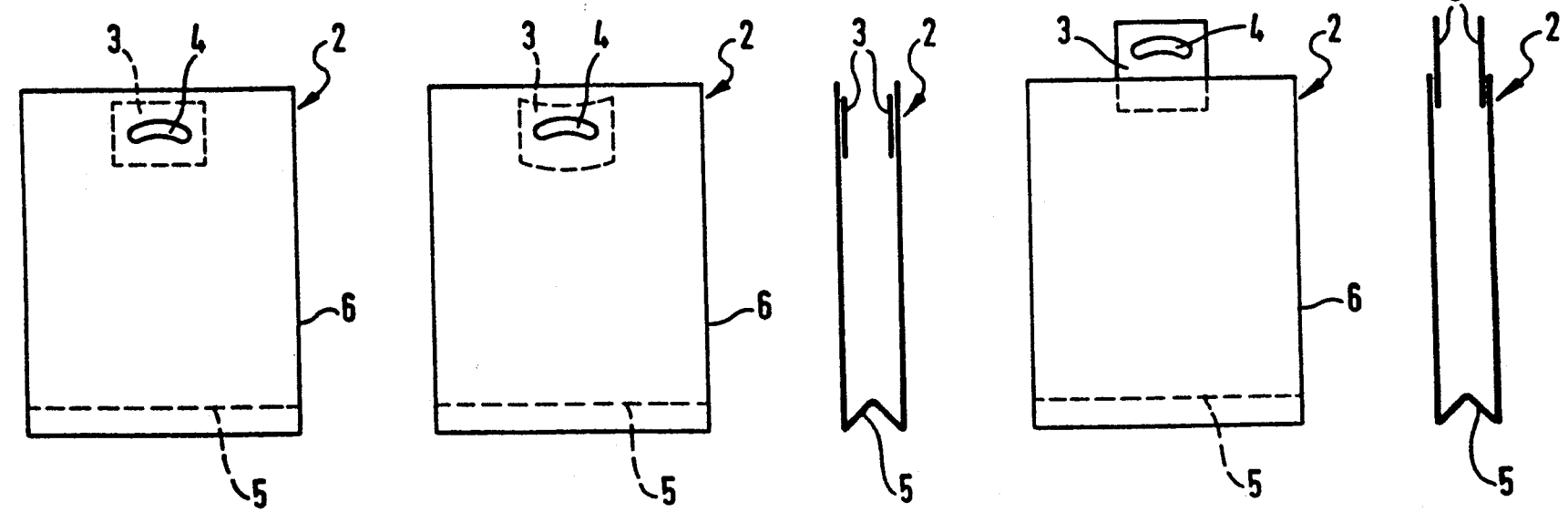
Figure 4A:
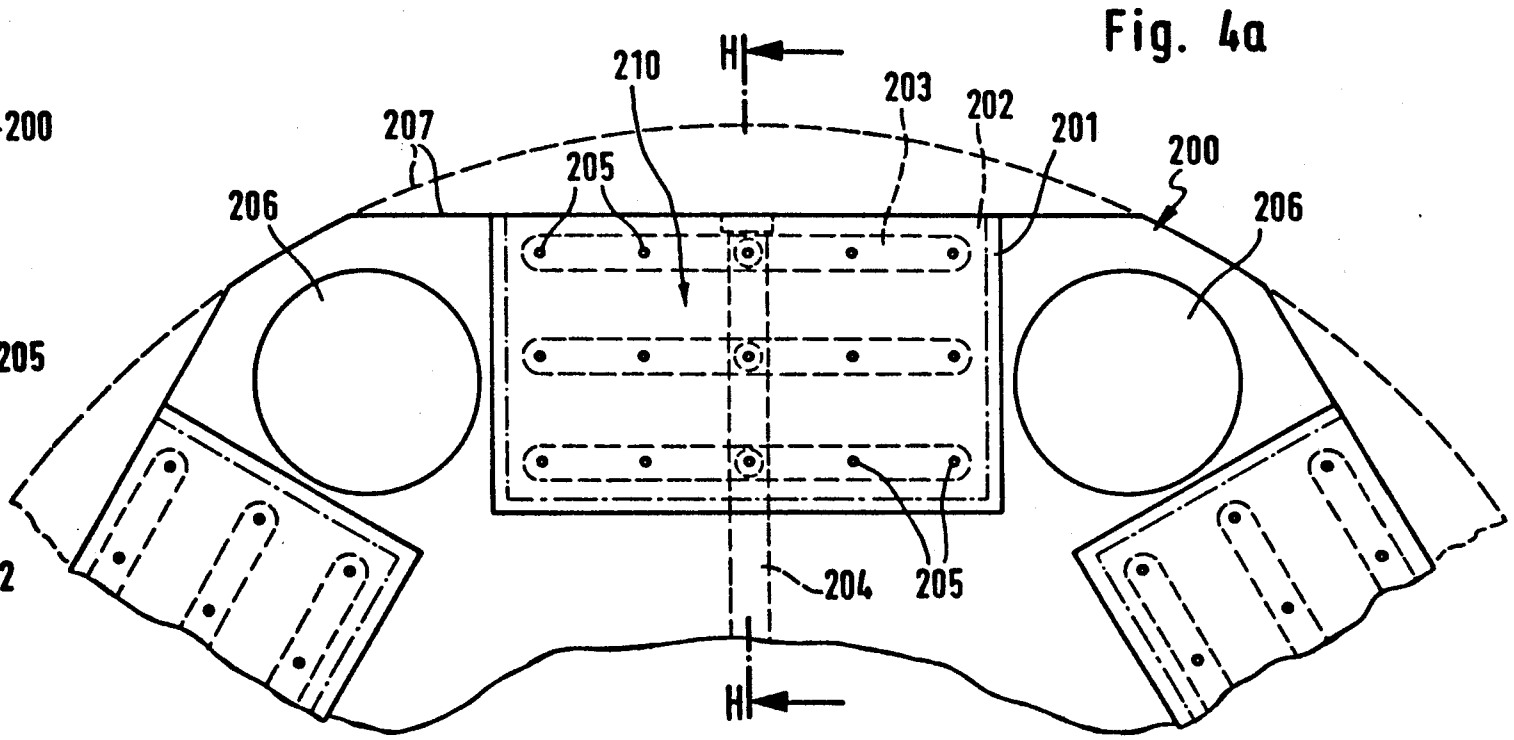

FIG. 4*a* shows, in an excerpt, a top view of the turntable 200 according to FIG. 5; in the zone of the holding sites 210, this turntable can be fashioned with a linearly extending end edge 207 or — as shown in dashed lines — with a circularly extending end edge. In case of a linear end edge, reinforcing tabs 3 of a rectangular shape are produced, see FIG. 3*a*, and in case of a round end edge 207, reinforcing tabs are produced as shown in FIG. 3*b* wherein the blades 220 in each case follow the contour of the end edge 207 of the turntable 200, i.e. they are straight or curved.

Figure 4B:
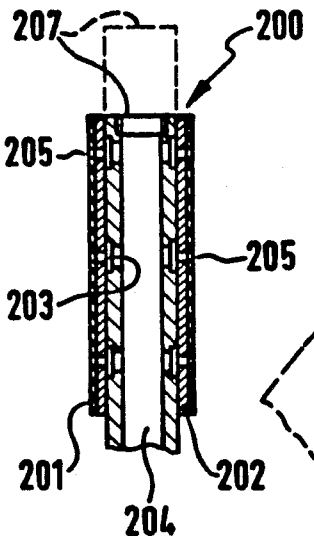

FIG. 4*b* shows a sectional view HH from FIG. 4*a*. The holes 206 provided between the individual holding places 210 serve for reducing the mass. The holding sites 210, in each case formed in pairs on the top and bottom sides, are characterized by a laid-on and fastened sheet metal plate 202 covered on the topside with a sponge rubber layer 201. Channels 203 and a bore 204 to which the vacuum is applied are provided in the turntable, see also section HH according to FIG. 4*b*. Small holes 205 lead from the channels 203 to the surface. The slide valves for application and interruption of the vacuum are located in the zone of the bores 204 outside of the holding places and are not illustrated. To prevent the holddown plate 225 from sticking to the reinforcing tabs when this plate is lifted after cutting the tabs, the holddown plate is preferably fashioned with grooves 228 on its surface, extending in parallel to the feeding direction V. The bore 204 is sealed at the end by means of a sealing plug 218, see also FIG. 9.

In order to permit flawless advance of the film strips and transfer from the separating plate 41 to the turntable 200 onto the holding sites 210, the rigidity of the film strips for the unsupported advance in this zone is increased by corrugating. This corrugation is not a permanent one but rather a short-time forming procedure which is again abolished, after the film strips have come to rest against the turntable, during the suctioning and holding down action exerted by the holddown plates, at the latest, so that the reinforcing tabs are smooth and of planar shape. The apex lines of the waves or ribs extend in this arrangement in the longitudinal extension of the film strips. Synthetic resin films of thermoplastic, heat-sealable plastics are chosen for the reinforcing tabs, which can be welded to the film web for the shopping bags. It is desirable to make these reinforcing tabs of maximum thinness in order to save material; on the other hand, limits are set in the downward direction for the thickness since the film strip must still be strong enough to withstand transfer from the separating plate 41 to the turntable 200, see FIG. 8, for example, in direction V without wrinkling and collapsing while being unsupported. For this reason, film strips of a thickness above 100 gm are usually employed for the reinforcing tabs. By the corrugation of the film strips obtained with the device according to this invention, it is possible to reduce the thickness of the strips while retaining adequate strength so that it is possible to utilize film strips even of a thickness of 50 pm on upward. This does not only mean a saving in material but also a shortened weld bonding time and cooling off period for the reinforcing tabs.

FIGS. 9 and 11 show a structural embodiment of the feeding device according to FIGS. 5–7 in the region of the separating plate 41 with grooves in an approximately full-size representation, in two sectional views, permitting the production of a longitudinal undulation of the film strips 40*a*, 40*b*, see schematic cross-sectional view of FIG. 10. The separating plate 41 extends into the close proximity of the cutting plane of the blades 220 extended in the gap toward the turntable. In the feeding zone of the film strips 40*a*, 40*b*, the separating plate tapers in a wedge configuration; in the outlet zone, the topside and bottom side of the separating plate extend in parallel to each other at the same level as the turntable 200, adjoining on the other side of the cutting plane of the blades 220; see also FIG. 8. The separating plate 41 is in this region provided with grooves 413 on the topside and bottom side, extending in the advancing direction of the film strips. The film strips 40*a* and 40*b*, respectively, are urged into these grooves by means of rack-shaped rods 43. The rack-shaped rods 43 are guided in a self-supported way in parallel within the grooves 413 and are held outside of the separating plate 41 in a toothed member 42 attached to the frame 32. The rack-shaped rods 43 terminate in a self-supported fashion with the separating plate 41, or shortly before this plate. Furthermore, in the zone of the separating plate 41, driven advancing rolls 44 are once again provided which are driven via chains 45 by the feed rolls 39, see FIG. 6. Counter rolls 46 are arranged in the separating plate 41 in the wedge-like tapering region, as an associate roll for the advancing rolls 44; these counter rolls are entrained by a frictional connection. The advancing rolls 44 as well as the counter rolls 46 are fluted, the grooves 441 of the advancing rolls 44 being in alignment with the grooves 461 of the counter rolls 46 and forming between them slotted chambers 47. The slotted chambers 47, in turn, are in alignment in the longitudinal direction with the grooves 413 of the separating plate and the rack-shaped rods 43 are likewise extended in a self-supporting fashion through these slotted chambers 47. In the regions of the rolls 44, 46 that are not grooved, the feed of the film strips 40*a* and 40*b*, respectively, takes place with entrainment in the gap 48 by way of friction. The parts of the film strips 40*a*, 40*b* guided through the slotted chambers 47 and, respectively, grooves 413 are shaped in a wave form in these zones by the toothed rods 43 and, thus corrugated, exit with a stable condition at the end of the separating plate 41 and permit a flawless, self-supported advance by pushing onto the turntable. After retaining the corrugated film strips on the holding places 210 on the topside and bottom side of the turntable, the film strips are severed by operating the cutting blades 220 in the direction of arrow S and thus the reinforcing tabs 3*a*, 3*b* are created.

What is claimed is:

1. An apparatus for the production of shopping bags made of thermoplastic synthetic resin, each bag having handles holes reinforced with welded-on reinforcing tabs made of thermoplastic synthetic resin film strips, said tabs surrounding the handle holes and being welded to sides of the bag, said apparatus comprising means for effecting cyclic stepwise advance of two film webs of thermoplastic synthetic resin forming the sides of each bag; feeding means for supplying two film strips of thermoplastic synthetic resin from which the reinforcing tabs are severed in a cyclic fashion with the advance of the film webs, said feeding means comprising a strip unwinding unit having feed rolls for the two film strips, a separating plate arranged between the two film strips for spacing apart the two film strips that are fed in superposition transversely to the advancing direction of the film webs, cutting means for severing the reinforcing tabs from the film strips, and a turntable rotatable about an axis perpendicular to the advancing direction of the film webs cyclically in synchronism with the stepwise advance of the film webs, said turntable having a portion projecting between the film webs and being equipped on a topside and a bottom side with holding places exposable to a vacuum for retaining the reinforcing tabs; a welding unit for welding the reinforcing tabs to the film webs being associate in each case on the topside and bottom side of the turntable with holding places extending farthest in between the film webs, holding places of the turntable for receiving the tabs being located outside of the film webs and adjoining the separating plate, an entrance gap being provided between the turntable and the separating plate; a punching unit for punching the handle holes into the welded-on tabs; and means for welding and severing of the shopping bags from the film webs transversely to the advancing direction of the film webs; the separating plate of the feeding means for the reinforcing tabs having, on the topside and the bottom side, grooves extending in the feeding direction of the film strips; drivable advancing rolls each provided with annular grooves and being associated with the topside and the bottom side, respectively, of the separating plate, each advancing roll cooperating with a counter roll which is arranged in the separating plate and which has annular grooves arranged so that grooves of the advancing roll and grooves of the counter roll are in mutual opposition and form slotted chambers in alignment with grooves of the separating plate; and rods arranged in a self-supporting fashion, extending through the grooves of the separating plate, as well as through slotted chamber, one rod associated with each groove in each chamber and a draw-through slot for the film strips formed between the zones of maximum diameter of the advancing rolls and the counter rolls and a route reinforced by rack-shaped rods in the slotted chambers whereby an undulated discharge gap for the film strips is formed transversely to the feeding direction of the film strips and, as seen in the feeding direction, downstream of an end of the separating plate; said cutting means comprising two blades that can be moved up and down transversely to the feeding direction of the film strips, one blade being disposed above and another blade being disposed below the separating plate.

2. An apparatus according to claim 1, wherein the separating plate tapers in a wedge shape in a feeding zone of the film strips; the advancing rolls and counter rolls are arranged in the wedge-shaped section; the rack-shaped rods are retained in a toothed member at an end extending past the wedge-shaped region of the separating plate against the feeding direction of the film strips.

3. An apparatus according to claim 1 or claim 2, wherein each blade is attached to a cutter bar vertically movable on guide rods; a holddown plate is mounted in a resiliently yielding fashion to the cutter bar, the surface of said holddown plate being ribbed or grooved in parallel to the feeding direction of the reinforcing tabs, and said holddown plate projecting somewhat past a blade cutting edge in the direction towards a receiving plate of the turntable.

4. An apparatus according to claim 1, wherein the feeding means further comprises a driven intermediate shaft from which are branched off individual driving means, respectively:

(1) for the feeding rolls for feeding the film strips;

(2) for the reciprocal motions of the blades of the cutting means for severing the reinforcing tabs from the film strips via a cam disk and a lever linkage;

(3) for the turntable with a stepping gear mechanism and control of the vacuum connection; and (4) for the reciprocating motion of the welding dies of the welding unit for welding the reinforcing tabs to the film webs by way of a cam disk and a lever linkage.

5. An apparatus according to claim 4, wherein the drive means for the feeding rolls can be turned on and off by means of a pneumatic operable single-speed clutch.

6. An apparatus according to claim 1, further comprising means for shaping a single film web into said two film webs, said web shaping means comprising a unit for folding the single film web into halves, each half forming a film web joined to another film web via a folded portion; said folding unit being arranged to direct the two film web halves into the means for effecting cyclic stepwise advance of the film webs forming the sides of each bag.

* * * * *